United States Patent [19]

Matsuda et al.

[11] 4,067,546

[45] Jan. 10, 1978

[54] OPERATING DEVICE FOR WINCH CONTROL VALVES

[75] Inventors: Kazuo Matsuda, Kyoto; Mitsuyoshi Wada, Yamatotakada; Kazumori Nishida, Hirakata, all of Japan

[73] Assignee: Kabushiki Kaisha Komatsu Seisakusho, Tokyo, Japan

[21] Appl. No.: 624,839

[22] Filed: Oct. 22, 1975

[30] Foreign Application Priority Data

Oct. 23, 1974 Japan ..... 49-127342[U]

[51] Int. Cl.[2] ..... B66D 1/00

[52] U.S. Cl. ..... 254/187.4; 74/471 R; 137/636

[58] Field of Search ..... 254/187 G, 166, 187 R, 254/187 E, 186 R; 74/471 R, 479; 192/13 A, 48.7, 16, 15; 137/636; 91/413

[56] References Cited

U.S. PATENT DOCUMENTS

| | | | |
|---|---|---|---|
| 2,958,384 | 11/1960 | Hull | 74/471 R |
| 3,407,682 | 10/1968 | Yoshizawa et al. | 74/471 R |
| 3,768,328 | 10/1973 | Campbell | 74/471 R |
| 3,854,380 | 12/1974 | Casey | 74/471 R |

*Primary Examiner*—Albert J. Makay

*Assistant Examiner*—Kenneth Noland

*Attorney, Agent, or Firm*—Armstrong, Nikaido & Marmelstein

[57] ABSTRACT

An operating device for winch control valves, featuring that, in a construction wherein a valve of a clutch for winding up a winch, a valve of a clutch for winding down the winch, and a valve of a brake can be operated by a single control lever to thus simplify the operation of the winch, the boss section of the primary lever linked with a spool of the valve for winding up the winch and the boss section of the secondary lever linked with a spool of the valve of the brake are put to interlocking rotation only at the time of rotation in the unitary direction, the boss section of the said secondary lever and the boss section of the tertiary lever linked with a spool of the valve for winding down the clutch are properly interlocked with each other only at the time of rotation in the unitary direction, a couple of positions as are confronted with each other on the both sides of the center of rotation of a rotator to be put to rotation either forward or backward by the operating lever are properly linked with the said primary lever and the said tertiary lever, respectively, through a loose mechanism.

4 Claims, 4 Drawing Figures

OPERATING DEVICE FOR WINCH CONTROL VALVES

BACKGROUND OF THE INVENTION

The present invention relates to an operating device for winch control valves as controls a plurality of valves by a single operating lever, to put it in more specific terms, an operating device for winch control valves of a pipe layer. A winch for a pipe layer is provided with a winding-up clutch, a brake, and a winding-down clutch, and, in the case of winding up the winch, the winding-up clutch is caused to come in contact in position, then a brake is released, meanwhile, in the case of winding down the winch, the winding-down clutch is caused to come in contact in position, then the brake is released, in the conventional construction of any type of operating device for winch control valves of a pipe layer.

However, the said conventional construction involves an inherent defect that the valve for the winding-up clutch, the valve for the winding-down clutch, and the valve for the brake have to be operated for the said actuation by proper switching-over therefor in a manner as to suit the respective cases, thus making the operation of the control valves quite complicated.

SUMMARY OF THE INVENTION

Now, one object of the present invention rests with providing an operating device for winch control valves as overcomes and eliminates the above-mentioned defect.

Another object of the present invention rests with providing an operating device for winch control valves as is well capable of conducting proper control of the said three valves by a single operating lever in conformity with a predetermined sequence of actuation.

In the case of the operating device for winch control valves introduced in the present invention, the valve for the winch winding-up clutch and the valve for the brake are so designed as to be caused to be put to proper actuation simultaneously when the operating lever is set at the position of UP, and the valve for the winch winding-down clutch and the valve for the brake are so designed as to be caused to be put to proper actuation simultaneously when the operating lever is set at the position of DOWN, whereby the above-mentioned objects can be properly attained.

Other objects, features, and advantages of the present invention will be readily made apparent through the following description given in conjunction with the accompanying drawings.

DETAILED DESCRIPTION OF THE INVENTION

A description of an illustration of the present invention will be given below by making reference to the accompanying drawings.

Figure 1:
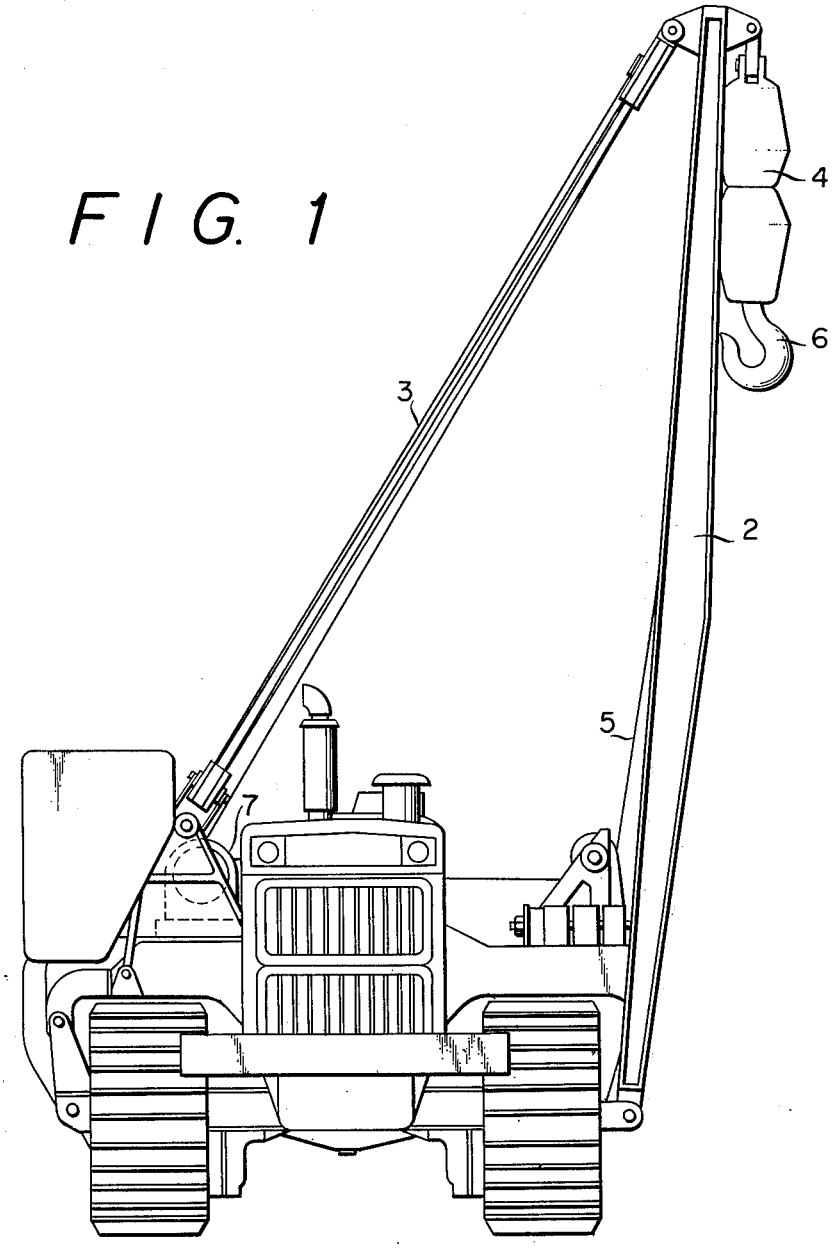
FIG. 1 is a front view of a pipe layer provided with the operating device for winch control valves introduced in the present invention.
Figure 2:
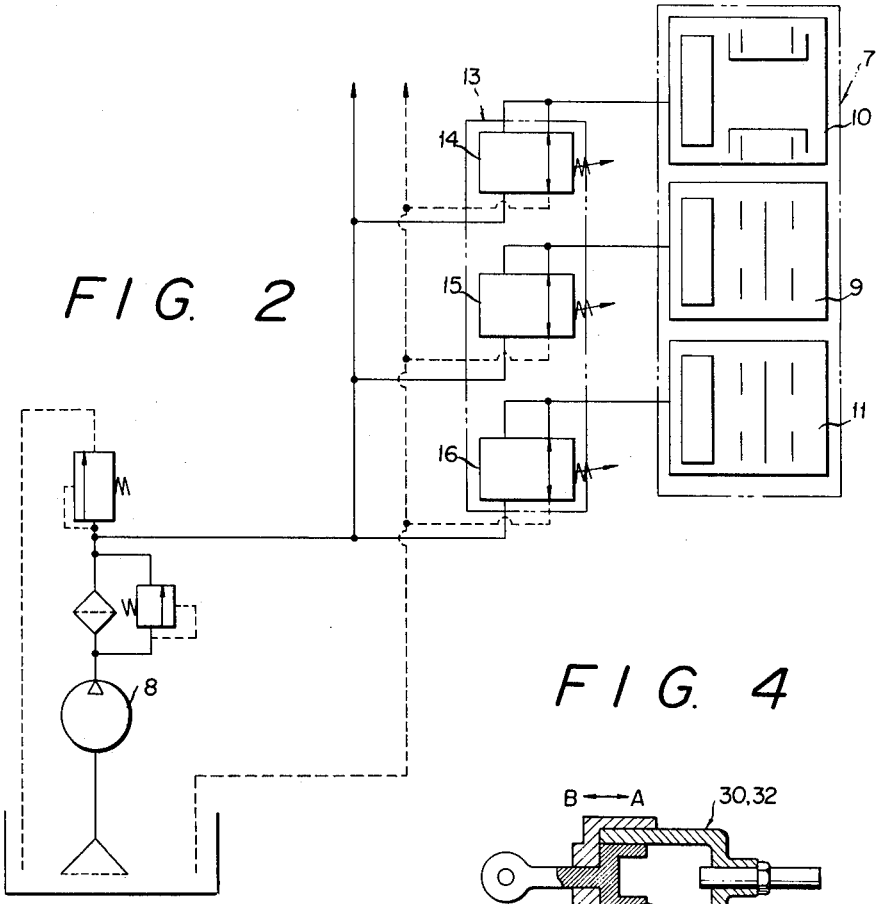
FIG. 2 is a diagrammatic explanatory drawing of the winch-actuating sections for the pipe layer.
Figure 4:
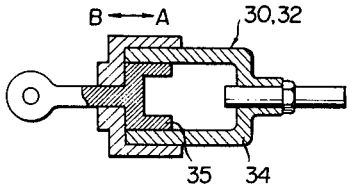
FIG. 4 is a sectional view of the loose mechanism.
Figure 3:
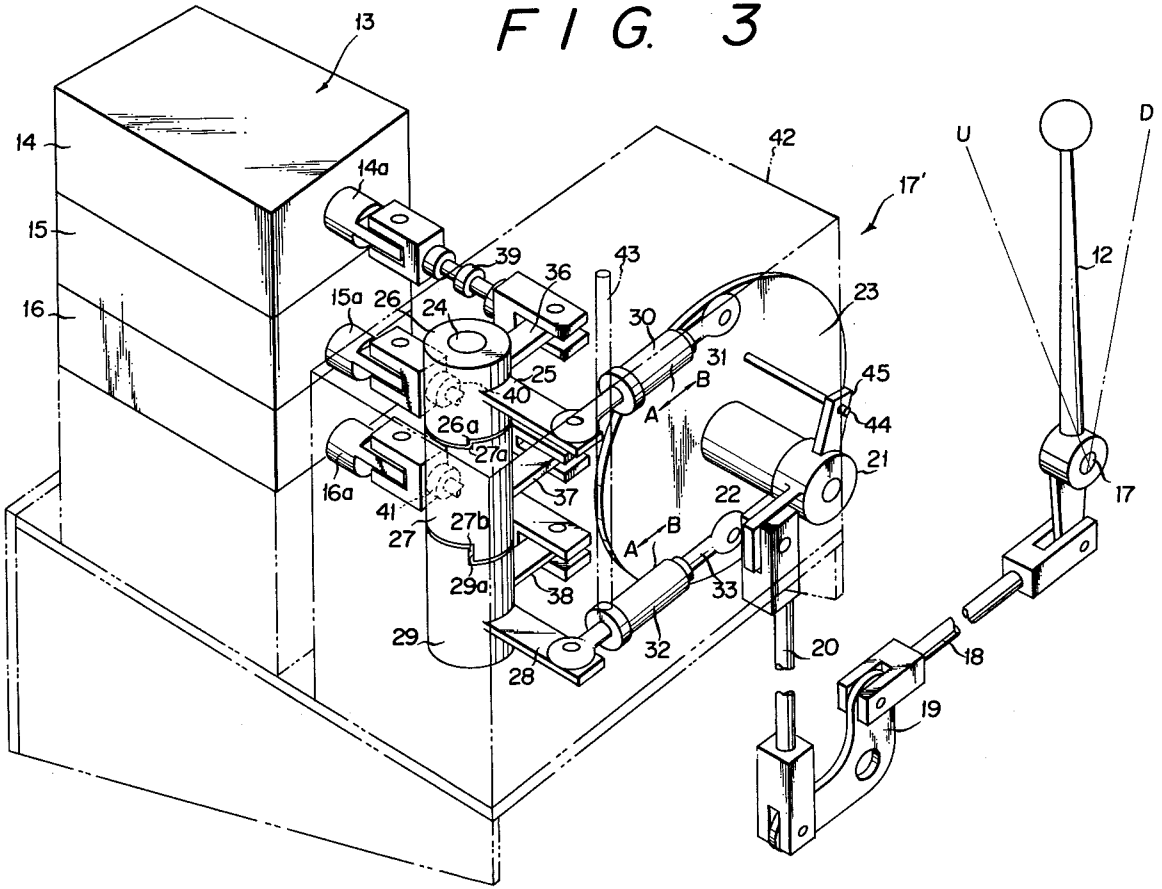
FIG. 3 is a perspective of the operating mechanism introduced in the present invention.

In the drawing, 1 is the body of a constructional vehicle as a bulldozer, the base end section of a boom 2 is pivotally supported on the side of the said body 1, and the boom 2 has the top side thereof supported by a wire 3 stretched between the top side thereof and body 1. Reference numeral 7 is a winch. The top side of the boom 2 is tiltable in the upward and downward directions by winding said winch 7. The boom 2 has a pulley 4 suspended at the top end thereof, and the said pulley 4 has a hook 6 suspended down from the top thereof by means of a wire 5. The base end section of the wire 5 is positioned on the opposite side of the boom 2, and is properly wound on a winch 7 (not shown in the drawing) set in place on the body 1. The winch 7 has a hook brake 9 and a pair of clutches 10, 11 for moving the hook upward and downward, respectively, properly arranged in place between a drum and a motive power system, not shown in the drawing, in a manner as is shown in FIG. 2, and the said hook brake 9 and the said clutches 10, 11 for moving the hook upward and downward, respectively, are properly connected with a hydraulic pressure supply source 8 through a group of operating valves 13 as are to be operated by a single operating lever 12. The said group of operating valves 13 comprise a valve 14 for the upper clutch 10, a valve 15 for the brake, and the valve 16 for the lower clutch 11 properly arranged vertically in that sequence, and are so designed as to be operated by the single operating lever 12 through an operating mechanism 17' as is shown in FIG. 3. The said operating lever 12 is properly pivoted in place on a fixed supporting shaft 17 arranged on an operator's seat, not shown in the drawing, in a manner as to be free to rotate, the free end of the said operating lever 12 has one end of an L-shaped lever 19 as is free to rock properly pivoted in place thereon through a horizontal rod 18, and the other end of the said L-shaped lever 19 has a vertical rod 20 properly pivoted in place thereon. The said vertical rod 20 is properly pivoted in place on an arm 22 of a horizontal shaft 21 as is free to revolve, and the said horizontal shaft 21 has a mounting plate 23 properly fixed in place thereon. 24 is a vertical supporting shaft, and the said vertical supporting shaft 24 has the boss section of the primary lever 25, an intermediate boss section 27, and the boss section 29 of the secondary lever 28 are externally fitted in place thereon in a manner as to be free to rotate in the vertical directions, the boss section 26 of the primary lever 25 and the intermediate boss section 27 have the steps **26*a*, 27*a* which form a primary engagement means as come in engagement, and in rotation together, with the primary lever 25 when the primary lever 25 rotates in the counterclockwise direction properly formed by scraping, and, the intermediate boss section 27 and the boss section 29 of the secondary lever 28, on the part thereof, have the steps 27*b*, 29*a* which form a secondary engagement means as come in engagement, and in rotation together, with the secondary lever 28 when the secondary lever 28** rotates in the counterclockwise direction properly formed by scraping, respectively.

The primary lever 25 is properly pivoted in place on the upper section of the said mounting plate 23, for proper connection therewith, through a rod 31 as is provided with a loose mechanism 30, and the secondary lever 28, on the part thereof, is pivoted in place on the lower section of the said mounting plate 23, for proper connection therewith, through a rod 33 as is provided with a loose mechanism 32. The said loose mechanisms 30, 32 are of a construction that a slide runner 35 is properly fitted in place into a cylindrical body 34 in a manner as to be free to slide, wherein the cylindrical body 34 and the slide runner 35 are caused to be transferred concurrently in the direction shown by an arrow A, meanwhile, only the cylindrical body 34 alone slides as far enough as to the stroke end thereof along the slide runner 35 in the direction shown by an arrow B.

Each and every one of the boss sections 26, 27, 29 has a corresponding arm 36, 37, 38 properly formed in a projecting manner, respectively, and the said arms 36, 37, 38 are properly pivoted in place on the spool 14*a* of the valve 14 for the upper clutch, the spool 15*a* of the valve 15 for the brake, and the spool 16*a* of the valve 16 for the lower clutch, for proper connection therewith, respectively, by means of turnbuckles 39, 40, 41.

Now, a description as to the actuation of the operating device will be given below.

When the operating lever 12 is set at the position bearing the mark of U by tilting the same for upward winding of a winch, the L-shaped lever 19 is caused to rotate in the clockwise direction, whereby the vertical rod 20 is pushed upward and the horizontal shaft 21 is caused to rotate in the clockwise direction. When the horizontal shaft 21 is thus caused to rotate in the clockwise direction, the mounting plate 23 is caused to rotate in the clockwise direction, whereby the primary lever 25 is caused to rotate in the counterclockwise direction by means of the rod 31. Now that the movement of the rod 33 is absorbed by the loose mechanism 32 at this time, the secondary lever 28 is kept free from being put to actuation. When the primary lever 25 rotates in the counterclockwise direction, the boss section 26 of the primary lever 25 and the intermediate boss section 27 are caused to rotate in the counterclockwise direction, the spool 14*a* of the valve 14 for the upper clutch and the spool 15*a* of the valve 15 for the brake are pushed in place by means of the arms 36, 37 and the turnbuckles 39, 40, thus causing the said spools 14*a*, 15*a* to be properly set at the working positions thereof, respectively. At this time, the rotation of the intermediate boss section 27 is kept free from being transmitted to the boss section 29 of the secondary lever 28.

Therefore, the upper clutch 10 is thus set at the position for contact, the brake 9 is put in the non-braking state, and the hook 6 starts rising upward.

When the operating lever 12 is set at the position bearing the mark of D by tilting the same for downward winding of the winch, the mounting plate 23 is caused to rotate in the counterclockwise direction in the same manner as is set forth above in the preceding paragraph, the boss section 29 of the secondary lever 28 and the intermediate boss section 27 are caused to rotate in the counterclockwise direction by means of the secondary lever 28, and are so actuated as to push in place the spool 15*a* of the valve 15 for the brake and the spool 16*a* of the valve 16 for the lower clutch 11, thus switching the same over to the working positions thereof, respectively. Therefore, the lower clutch 11 is thus properly set at the position for contact, the brake 9 is put in the non-braking state, and the hook 6 starts descending downward.

The hook 6 can thus be caused to ascend upward and descend downward as well readily enough by a simple operation of tilting the operating lever 12.

42 in the drawing is a cabinet for enclosing the said operating mechanism 17 as is designed specifically for the purpose of preventing dust or the similar foreign matter from adhering to the operating mechanism 17.

And, 43 is a fixing bar inserted in place into the arm 37 of the intermediate boss section 27, and 44 is a fixing bar inserted in place into the lever 45 of the horizontal shaft 21, and, when respective turnbuckles 39, 40, 41 are properly clamped in a state that the intermediate boss section 27 and the horizontal shaft 21 are fixed in place by means of the said fixing bars 43, 44, the said respective boss sections 26, 27, 29 are kept free from rotating in the counterclockwise direction; therefore, the said respective spools 14*a*, 15*a*, 16*a* are thus caused to be drawn out as far enough as up to the stroke ends thereof, whereby the said spools 14*a*, 15*a*, 16*a* of the respective valves 14, 15, 16 can thus be properly set at the original points (the neutral positions) thereof. Furthermore, when the loose mechanisms 30, 32 are properly clamped in the above-mentioned state, the play therefor can be reduced down to the lever of zero.

To put it otherwise, the operating mechanism 17 can be properly adjusted in a manner as to be put in the normal state thereof simply enough by merely inserting the respective fixing bars 43, 44 in place and clamping the respective turnbuckles 39, 40, 41, also the loose mechanisms 30, 32, thus enabling the adjustment and the control thereof to be simplified a great deal.

Now that the operating device for winch control valves introduced in the present invention is of a construction as is set forth in the preceding paragraphs, the primary boss section 26 is properly caused to rotate in the unitary direction by causing the rotator 23 to be put to forward rotation by the operating lever 12, and the tertiary boss section 29 is properly caused to rotate in the unitary direction by causing the rotator 23 to be put to backward rotation by the operating lever 12.

Therefore, the primary valve 14 and the secondary valve 15, or the secondary valve 15 and the tertiary valve 16, can be properly actuated through switching-over to that effect simply enough by the operation of the operating lever 12, which enables the said three valves 14, 15, 16 to be operated in a proper manner through switching-over for actuation in conformity with a predetermined sequence of actuation simply enough by the operation of the single operating lever 12, and, in case this operating device is selected as a valve operating mechanism for operating a winch for a pipe layer, the operation of the winch for the pipe layer can be simplified a great deal.

What is claimed is:

1. An operating device for winch control valves, comprising an operating lever, a rotator as is connected with the said operating lever, and is put to rotation by operating the said operating lever, a primary lever means having a cylindrical boss section provided therefor, a secondary lever means having a boss section mounted in place on the same shaft as said boss section of the primary lever means, an intermediate boss section positioned between the said boss section of the primary lever means and said boss section of the secondary lever means, mounted in place on the same shaft as said boss section of the primary lever means and said boss section of the secondary lever means, a plurality of coupling means coupling said rotator with said primary lever means and said secondary lever means, a primary valve means connected with said boss section the primary lever means, a secondary valve means connected with said intermediate boss section, a tertiary valve means connected with said boss section of the secondary lever means, a primary engagement means for interlocking said boss section of the primary lever means and said intermediate boss section for rotation only at the time of their rotation in a first direction, and, a secondary engagement means for interlocking said boss section of the secondary lever means and said intermediate boss section for rotation only at the time of their rotation in said first direction.

2. The operating device for winch control valves set forth in the claim 1 above, wherein the said means for coupling the said rotator with the said primary lever means and the said secondary lever means is a loose coupling.

3. The operating device for winch control valves set forth in the claim 1 above, wherein the said primary engagement means and said secondary engagement means are respectively a step formed on the boss section.

4. The operating device for winch control valves set forth in the claim 1 above, wherein said primary valve means, said secondary valve means, and said tertiary valve means are clutch valves for winding up a winch, a brake valve, and a clutch valve for winding down the winch, respectively.

* * * * *